US007048601B2

(12) United States Patent
Sclafani

(10) Patent No.: US 7,048,601 B2
(45) Date of Patent: May 23, 2006

(54) SWIMMING FLIPPER WITH BLADE AND FOOTWEAR STRUCTURE

(76) Inventor: Maria G. Sclafani, 3052 Braemer Dr., Cameron Park, CA (US) 95682

( * ) Notice: Subject to any disclaimer, the term of this patent is extended or adjusted under 35 U.S.C. 154(b) by 0 days.

(21) Appl. No.: 10/817,136

(22) Filed: Apr. 1, 2004

(65) Prior Publication Data

US 2005/0221698 A1 Oct. 6, 2005

(51) Int. Cl.
*A63B 31/08* (2006.01)

(52) U.S. Cl. ..... 441/64

(58) Field of Classification Search ..... 441/61, 441/62, 63, 64
See application file for complete search history.

(56) References Cited

U.S. PATENT DOCUMENTS

| | | | | |
|---|---|---|---|---|
| 2,903,719 | A * | 9/1959 | Wozeneraft | 441/64 |
| 3,178,738 | A | 4/1965 | La Trell | 9/309 |
| 5,151,060 | A | 9/1992 | Lam | 441/62 |
| 5,324,219 | A | 6/1994 | Beltrani et al. | 441/64 |
| 5,593,333 | A * | 1/1997 | Johnson | 441/62 |
| 5,632,662 | A * | 5/1997 | Cadorette | 441/63 |
| 5,924,902 | A | 7/1999 | Burns et al. | 441/64 |
| 6,182,377 | B1 * | 2/2001 | Toensing | 441/64 |
| 6,290,560 | B1 | 9/2001 | Kidd et al. | 441/64 |
| 6,398,605 | B1 * | 6/2002 | Gibbons et al. | 441/64 |

* cited by examiner

*Primary Examiner*—Lars A. Olson
(74) *Attorney, Agent, or Firm*—Schneck & Schneck; Gina McCarthy; Nissa M. Strottman

(57) ABSTRACT

A swimming flipper comprising a blade and a footwear structure disengagingly coupled with the blade, the footwear structure including a sole and a pair of flaps attached to the sole. The flaps are attachable to and detachable from each other and are comprised of a conformable material that is wrapped about a dorsal portion of a user's foot.

3 Claims, 4 Drawing Sheets

SWIMMING FLIPPER WITH BLADE AND FOOTWEAR STRUCTURE

TECHNICAL FIELD

The present invention relates to swimmers' aids adapted to be connected to swimmers' feet, in general, and to swimming flippers including a blade and a footwear structure, in particular.

BACKGROUND ART

Swimming flippers including a shoe disengageable from a blade are known in the art. For instance, U.S. Pat. No. 5,324,219 to Beltrani et al. discloses a swimming flipper including a blade and a shoe constituted of two separable elements. The heel portion of the shoe is provided with a hooking-tooth back appendage and the blade includes a recess to be snap engaged by the hooking tooth.

U.S. Pat. No. 2,903,719 to Wozencraft describes a shoe worn by a swimmer which is secured to a fin. The shoe is inserted in a frontward pocket of the fin and a strap is brought over the instep of the swimmer's foot and fastened in place.

U.S. Pat. No. 5,151,060 to Lam describes a swimming flipper having a disengageable shoe and fin. A hinge connects the bottom portion of the shoe with the front portion of the fin and allows the shoe to rotate with respect to the fin.

U.S. Pat. No. 3,178,738 to Trell describes a swim fin which is attachable to and releasable from a shoe which may remain on the foot of a swimmer. The shoe has an extending flange portion which forms a tongue and the removable fin has a tongue receiving groove.

Such swimming flippers are advantageous in that they allow a user to remove the blade from the shoe when it is desired to walk in the shoe structure without the blade. For instance, it is desirable to detach the blade from the shoe when walking up a swimming pool ladder or when walking to a swimming pool. Such swimming flippers are also advantageous in that they allow a user to attach the shoe to the blade when it is desired to walk in the shoe structure with the blade. For instance, it is desirable to attach the blade to the shoe to facilitate underwater movement in those areas of the water where movement with a blade is desirable.

Those suffering from debilitating foot conditions have difficulty engaging in various exercises, such as running, that require applying pressure to the feet. Therefore, oftentimes those people are prescribed water therapy/swimming, as swimming tends not to be as painful to sufferers of various foot conditions as other forms of exercise tend to be. Swimming flippers are desired while swimming to protect feet from injury and to facilitate underwater movement. However, those suffering from foot pain typically have difficulty inserting their feet into the shoes associated with some swimming flippers of the prior art. Typically, a swimming flipper of the prior art require that the user insert his foot within a relatively small opening to properly position the shoe on the user's foot. This can be painful and challenging for a person suffering from serious foot conditions. For example, it would likely be painful for a person with diabetes suffering from foot swelling, ulcers, or other sores to squeeze his foot into or out of the opening of the swimming flipper shoe. Furthermore, materials of many prior art shoes associated with swimming flippers are rigid and are thus likely to cause pain to the user upon contact with a foot of a person suffering from a painful foot condition.

Therefore, it is an object of the present invention to provide a swimming flipper that is relatively easy for a person suffering from a painful foot condition to utilize without anyone's aid.

It is an additional object of the present invention to provide a swimming flipper that is relatively easy to utilize.

It is an additional object of the present invention to provide an improved footwear structure for coupling with a swimming flipper blade.

It is a further object of the present invention to provide an improved swimming flipper.

SUMMARY OF THE INVENTION

The above and other objects have been achieved by a swimming flipper comprising a blade and a unique footwear structure removably coupled with the blade. The footwear structure includes a sole and a pair of flaps attached to the sole which are attachable to and detachable from each other. The flaps are comprised of a conformable material, such that the flaps are conformable about the user's foot.

The footwear structure is comprised of a single material or a combination of different materials. Where a combination of materials is used, the footwear structure, or parts of the footwear structure including the heel, sole, and flaps, may comprise a cushioned material. The material that is cushioned is desirably hard enough so that the footwear structure is resistant to wear, weather, chlorine, etc., and is longer lasting. A cushioning material assists in making the footwear structure comfortable to wear and utilize. The cushioning material may comprise neoprene and the cushioned material may comprise rubber. The rubber may be relatively rigid or hard and may include projections to assist the user in gripping a groundsurface when walking or in facilitating underwater movement. The footwear sole, flaps, and heel may have the same or a different composition.

The unique footwear structure differs from a swimming flipper shoe of the prior art in at least that with the footwear structure a user need merely place his foot on the sole and wrap the flaps about his foot to wear the footwear structure. A user suffering from a painful foot condition will experience less pain when affixing the footwear structure to his foot than he would in "putting on" a prior art swimming flipper shoe, as with the prior art shoe the user is required to insert his foot within an opening found in a prior art swimming flipper shoe. Where the user has a painful foot condition insertion of his foot within the opening, can be very painful.

The swimming flipper of the present invention further includes means to removably couple the blade of the swimming flipper to the footwear structure. For example, the footwear structure includes a front projection cooperating with a front locking housing disposed on the blade. Further, the blade includes, for example, a recess into which the user wearing the footwear structure inserts the sole of the footwear structure. The footwear structure is snugly received within the recess and the front portion of the footwear structure is locked into the blade.

In one example, a pair of straps is attached to either side of the blade. When a user has affixed the footwear structure to his foot, the bottom of the footwear structure is placed on an upper portion of the blade and the straps are wrapped about a dorsal portion of the foot and are affixed to each other to secure the footwear structure to the blade. An additional strap may be included to secure the footwear structure to the blade. The strap may be threaded through a loop affixed to a rear of the blade. The coupling means may be utilized alone or in combination with other coupling means.

BEST MODE FOR CARRYING OUT THE INVENTION

Figure 1B:
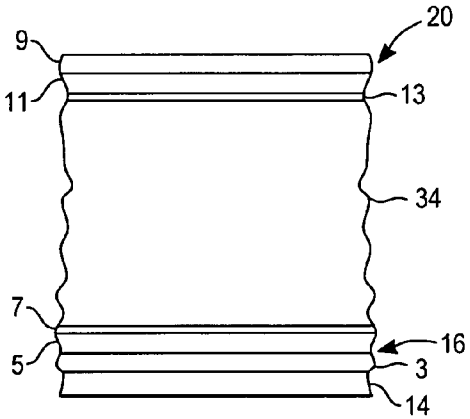
FIG. 1*b* is a cutaway view of one embodiment of the swimming flipper of FIG. 1*a*.
Figure 1A:
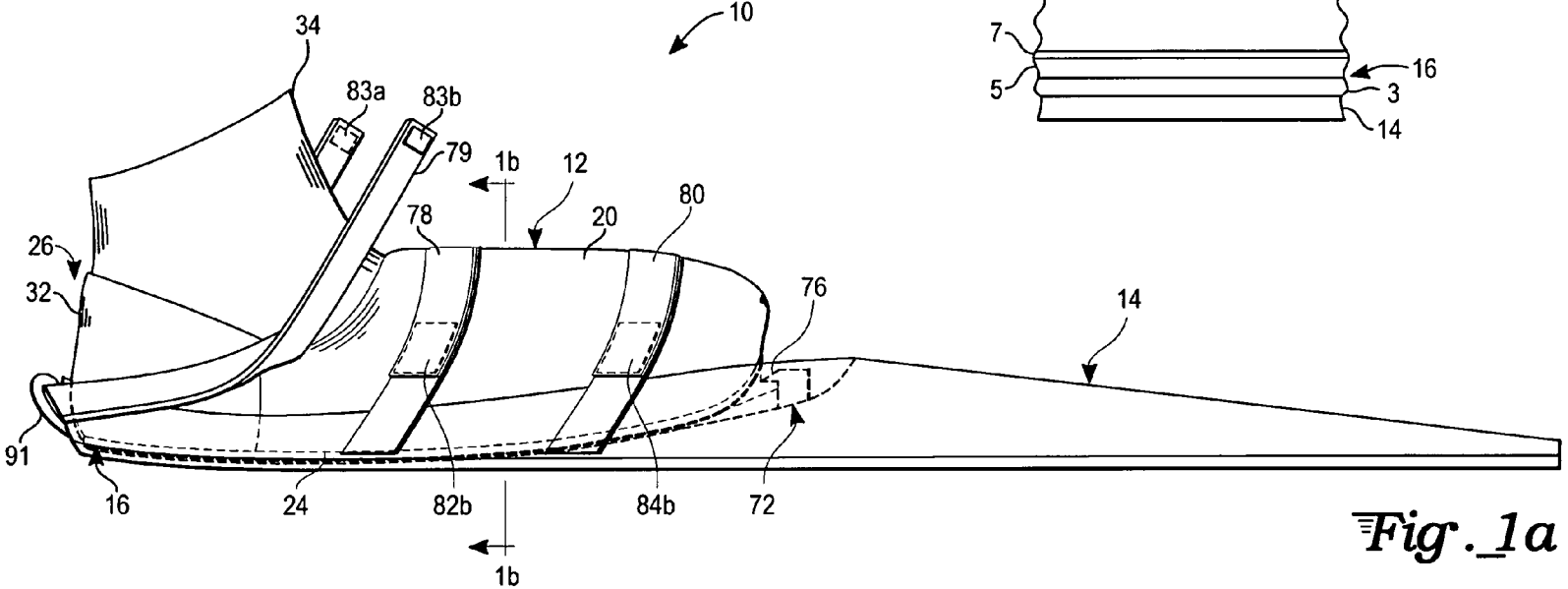
FIG. 1*a* is a perspective view of the swimming flipper of the present invention with a footwear structure coupled to a blade.
Figure 2:
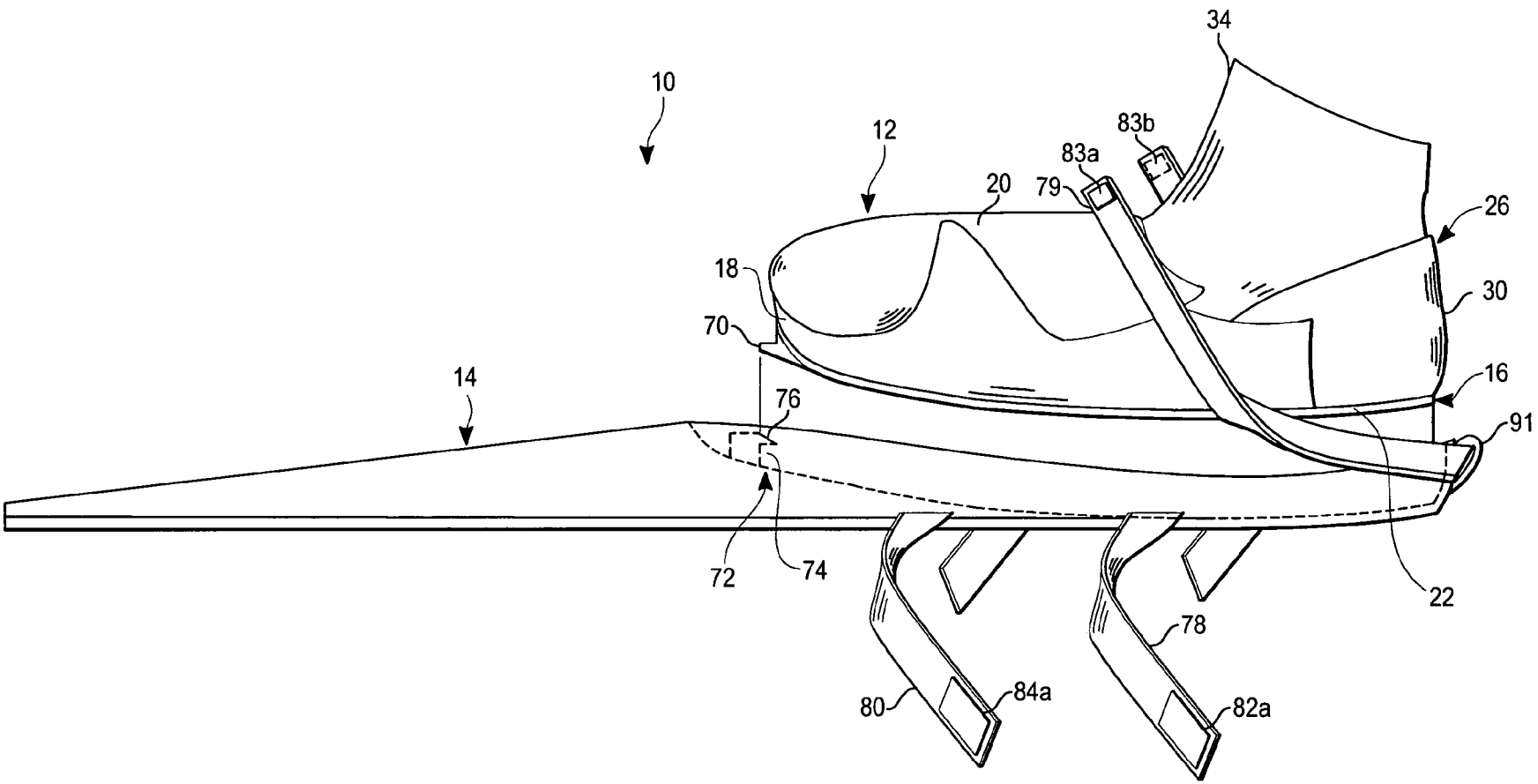
FIG. 2 is another perspective view of the swimming flipper of FIG. 1*a* with the footwear structure uncoupled from the blade.

With reference to FIGS. 1*a* and 2, there is seen a swimming flipper 10 of the present invention featuring a footwear structure 12 and a blade 14. The footwear structure 12 is removably coupled to the blade 14. The footwear structure 12 includes a sole 16, and a first flap 18 and a second flap 20 each comprised of a conformable material. Flaps 18 and 20 are attachable to and detachable from each other. The first flap 18 is attached to a first lateral side 22 of the sole 16 and the second flap 20 is attached to a second lateral side 24 of the sole 16, by sewing or by otherwise uniting. A heel 26 comprised of, for example, plastic, is attached to a rear of the sole 16 by molding or otherwise uniting. The heel 26 includes a rear surface 28 (FIG. 3) and side surfaces 30 and 32. Flap 18 is attached to side surface 30 of the heel 26. Flap 20 is attached to side surface 32 of the heel. Flaps 18 and 20 are removably attached to each other. When attached to each other, the flaps conform about a user's foot 34 at a dorsal foot portion, as seen in FIG. 3*c*.

With reference to FIGS. 1*a* and 1*b*, the footwear structure is comprised of a single material, in one embodiment, or a combination of different materials in another embodiment. Specifically, the footwear structure sole 16 is comprised of a single material or a combination of materials. Where a combination of materials is used, as shown in FIG. 1*b*, the sole 16 may comprise a cushioned material 3. The material that is cushioned 3 is desirably hard enough so that a user may walk in and otherwise utilize the footwear structure and so that the cushioned material is resistant to wear, weather, chlorine, etc. and is longer lasting. A cushioning material 5 assists in making the footwear structure comfortable to wear and utilize. The cushioning material 5 may comprise neoprene and the cushioned material 3 may comprise rubber. The rubber may be substantially rigid or hard. In one example, a lower surface cushioned material 3 of the sole comprises substantially rigid rubber, to withstand surfaces upon which the user walks, and an upper surface cushioning material 5 of the sole comprises neoprene, to provide cushioning to the user. The neoprene may be covered with a material 7, such as cloth, which may feel better to the user than the neoprene when resting his foot 34 on it.

The footwear structure flaps 18 and 20 are comprised of a single material or a combination of materials. Where a combination of materials is used, the flaps may comprise a cushioned material 9. The material that is cushioned is desirably harder than a cushioning material 11 so as to assist in making the flaps resistant to wear, weather, chlorine, etc. and longer lasting. A cushioning material 11 assists in making the footwear structure comfortable to wear and utilize. The cushioning material 11 may comprise neoprene and the cushioned material 9 may comprise rubber. The rubber should be harder than the cushioning material 9 but should be compliant so that it is conformable about the user's foot. In one example, an upper surface cushioned material 9 of the flap comprises a resistant rubber and the lower surface cushioning material 11 of the flap comprises neoprene. The neoprene or other cushioning material 3 may be covered with a material 13, such as cloth, which may feel better to the user than the neoprene when the flaps are wrapped about the user's foot 34.

Figure 3D:
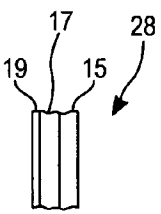
FIG. 3*d* is a cutaway view of a portion of the footwear structure heel of FIG. 3*c*.

With reference to FIG. 1*a* and FIG. 3*d*, the footwear structure heel 26 is comprised of a single material or a combination of materials. Where a combination of materials is used, heel 26 may comprise a cushioned material 15. The material that is cushioned 15 is desirably harder than a cushioning material 17 so as to assist in making the heel 26 resistant to wear, weather, chlorine, etc. and in making the heel longer lasting. A cushioning material 17 assists in making the footwear structure comfortable to wear and utilize. The cushioning material 17 may comprise neoprene and the cushioned material may comprise rubber. The rubber should be harder than the cushioning material 17 but should be compliant so that it is conformable about the user's heel. In one example, outer surface cushioned material 15 of the heel comprises a resistant rubber and inner surface cushioning material 17 of the heel comprises neoprene. The neoprene may be covered with a material 19, such as a cloth, which may feel better to the user than the neoprene when the heel portion of the footwear structure is pressed against a heel of the user's foot.

The footwear structure sole, flaps and heel may have the same composition or a different composition and may be comprised of one or more of the materials mentioned above, in addition to other materials, such as plastic. The cushioned material in each of the sole, flaps, and heel may include projections (not shown). For example, projections disposed on an outer surface of the cushioned material 3 of the sole 16 may assist the user in gripping a ground surface when walking with the footwear structure. Projections disposed on the sole, flaps, or heel may also facilitate underwater movement.

Figure 3A:
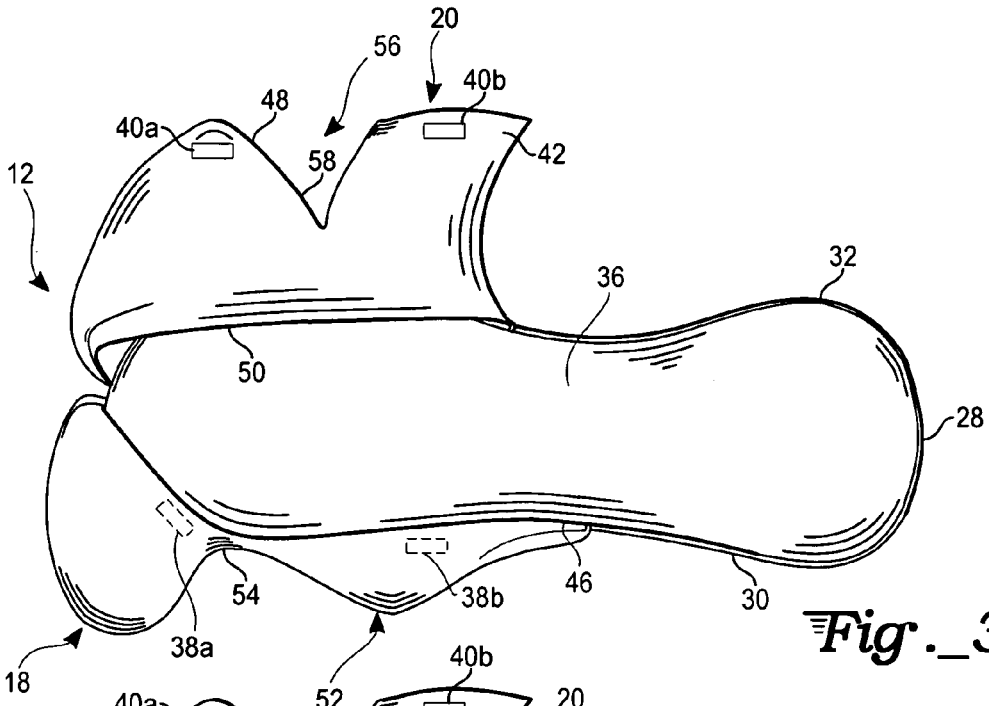
FIG. 3*a* is a perspective view of the footwear structure of the swimming flipper of FIG. 1*a* in an unattached position.

Referring to FIG. 3*a*, the flaps 18 and 20 of the footwear structure 12 are seen in an unattached position. Flap 18 includes an end 44 which opposes end 46 attached to the sole 16. Flap 20 includes an end 48 which opposes end 50 attached to the sole 16. Further, flap 18 is attached to a front portion of the sole 16, in coverable relation with respect to the user's toes (not shown). In the unattached position, when foot 34 (FIG. 3*b*) is not disposed on a top surface 36 of sole 16, the flaps are moveable to reveal a substantial portion, or all, of the top surface 36 of the sole 16. Thus, it is simple for the user to affix the footwear structure 12 to his foot 34 by stepping onto the top surface 36 of the sole 16 and by wrapping each of the flaps 18 and 20 about the dorsal portion of his foot 34.

Figure 3B:
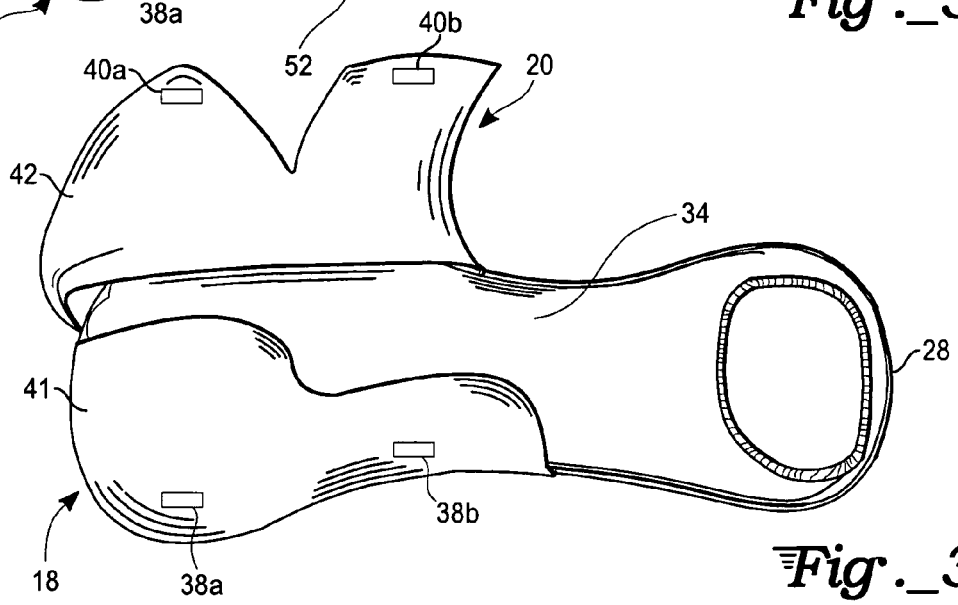
FIG. 3*b* is a perspective view of the footwear structure of FIG. 3*a* in an intermediate position.
Figure 3C:
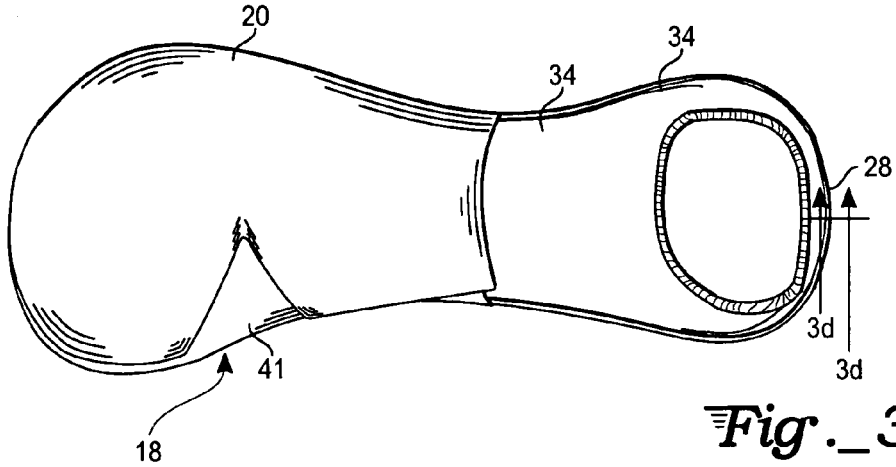
FIG. 3*c* is a perspective view of the footwear structure of the swimming flipper of FIG. 3*b* in an attached position.

Referring to FIGS. 3*a,* 3*b,* and 3*c,* the flaps 18 and 20 cover the dorsal portion of the foot 34 and include means for attaching the flaps 18 and 20 to each other. Referring to FIG. 3*b,* flap 18 is wrapped about the dorsal portion of the foot 34 before flap 20 is wrapped about the dorsal portion of the foot and flap 18. In one example, flap 18 includes attachment means 38*a* and 38*b* on an outside surface 41. Flap 20 includes attachment means 40*a* and 40*b* (FIG. 3*a*) on an inside surface 42 and is wrapped about a dorsal portion of the foot 34 and attached to outside surface 41 of flap 18. Attachment means, comprise, for example, a hook and loop type fastener, such as the type sold under the trademark Velcro®. Flap 20 crosses over flap 18, in the pictured embodiment. The flaps 18 and 20, in one example, attach to each other at the dorsal portion of the user's foot 34. The position of the flaps 18 and 20 may be reversed, if desired.

In the pictured embodiment, as seen in FIG. 3*a*, flap 18 has a zig-zag perimeter 52 including a cutout 54 and flap 20 has a zig-zag perimeter 56 including a cutout 58. When flap 20 crosses over flap 18, the cutout 54 of zig-zag perimeter 52 of flap 18 is covered by flap 20. The cutout 58 of zig-zag perimeter 56 of flap 20 rests on flap 18 so that it is filled in.

Referring to FIG. 3*a*, flap 18 has a length less than a length of lateral side 22 (FIG. 2) and flap 20 has a length less than lateral side 24 (FIG. 1*a*). In one example, each flap 18 and 20 has a length greater than half the length of the corresponding lateral sides 22 and 24, respectively. The footwear structure 12 is made with varying lengths of flaps and soles so that the footwear structure is affixable to various sizes of feet.

Figure 4:
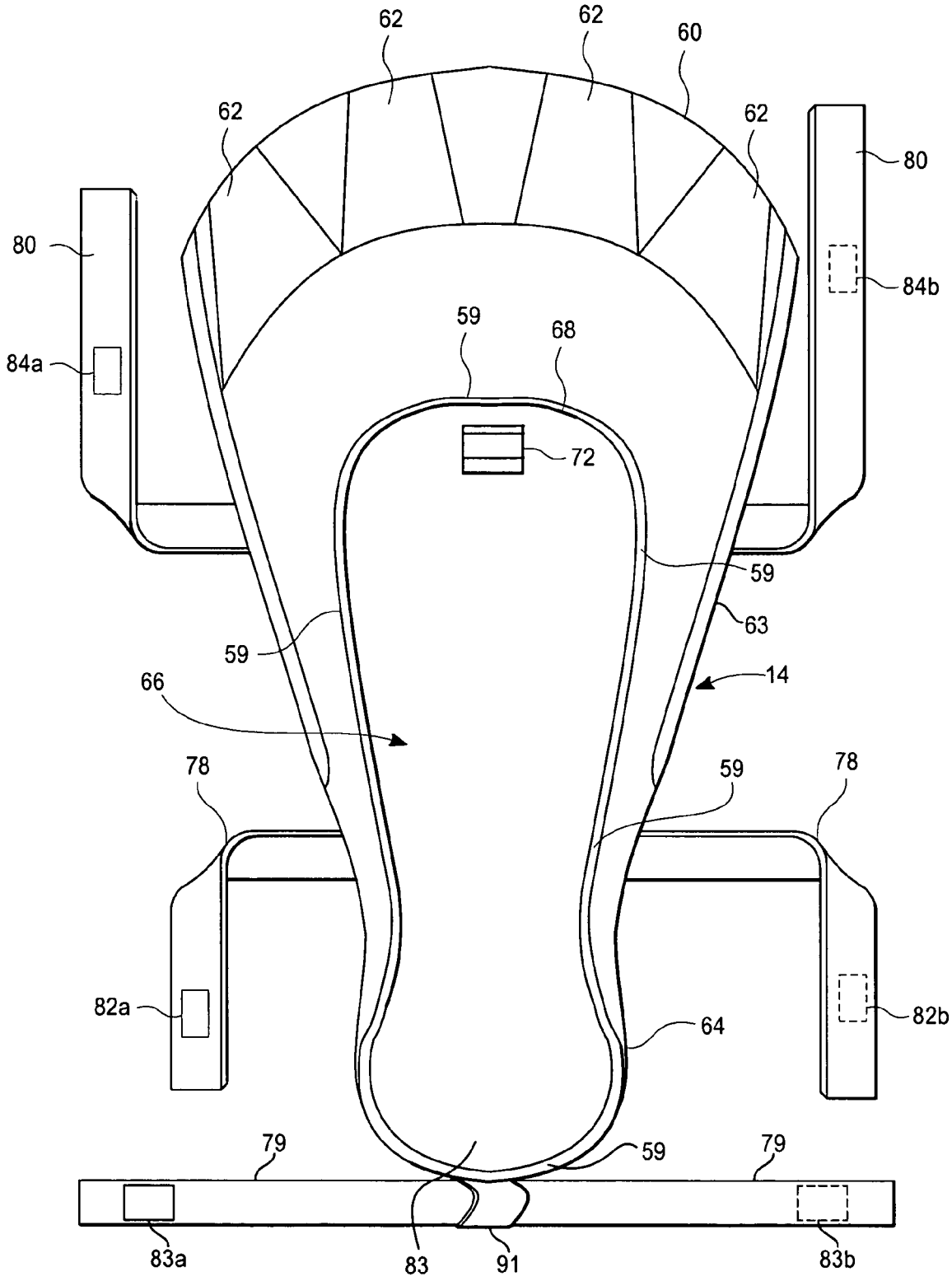
FIG. 4 is a perspective view of the blade of the swimming flipper of FIG. 1*a*.

Referring to FIGS. 1*a*, 2, and 4, the blade 14 includes a frontwardly extending outwardly flared portion 60 with longitudinal ribs 62. The ribs 62 add strength and rigidity to the blade 14. The blade 14 also has a tapered intermediate portion 63 and a rear heel portion 64. The intermediate and rear portions 63 and 64 are attached to the frontwardly extending outwardly flared portion 60 by molding as one piece, or by otherwise uniting. The blade 14 is comprised of a flexible and relatively rigid material, such as plastic. In one example, the frontwardly extending outwardly flared portion 60 is less rigid than the intermediate and rear portions 63 and 64.

The footwear structure 12 is removably or disengagedly coupled to the blade, as seen in FIGS. 1*a* and 2. For example, with reference to FIG. 4, the intermediate and rear portions 63 and 64 are recessed such that the footwear structure 12 may be inserted and snugly received within recess 66, securing the footwear structure 12 to the blade 14. When the user inserts the footwear structure 12 within the recess 66, sides 59 of the recess 66 flex outwardly and contract to snugly receive the footwear structure 12. When the user removes his foot and the affixed footwear structure 12 from the blade 14, the recess sides 59 contract after removal. In one example, the recess 66, including recess sides, is more rigid than the frontwardly extending outwardly flared portion of the blade 60.

The recess 66 should be accompanied by additional means for securing the footwear structure 12 to the blade 14. Such means may include attachment means found in skis and ski boats. In one example, with reference to FIGS. 1*a*, 2, and 4, the front portion of the footwear structure 12 includes means for securing the footwear structure 12 to the blade 14. The footwear structure 12 includes a front projection 70 which cooperates with a front locking housing 72 disposed on the blade 14. The front projection 70 is inserted within housing recess 74 where protrusion 76 prevents the projection from moving upwardly. Thus, the front portion of the footwear structure 12 is reversibly locked onto the blade 14.

In another example, with reference to FIGS. 1*a,* 2, and 4, straps 78, 79, and/or 80 are attached to blade 14. When a user has affixed the footwear structure 12 to his foot 34, the bottom of the footwear structure 12 is placed on an top surface 83 of the blade and one or more of the straps 78, 79, and 80 are used to secure the footwear structure 12 to the blade 14. One side of strap 78 is secured to another side of the strap 78 through attachment means 82*a* and 82*b* after strap 78 is wrapped about the footwear structure (and a portion of the user's foot beneath the footwear structure). One side of strap 80 is secured to another side of the strap 80 through attachment means 84*a* and 84*b* after strap 80 is wrapped about the footwear structure (and a portion of the user's foot beneath the footwear structure). One side of strap 79 is secured to another side of strap 79 through attachment means 83*a* and 83*b* after strap 79 is wrapped about a rear portion of the footwear structure and a portion of the user's foot. Attachment means include for example, hook and loop type fastener sold under the trademark Velcro ®. With regard to strap 79, it is threaded through a loop 91 secured to a rear portion of the blade 14. The loop may comprise, for example, neoprene or rubber. The loop 91 may be used to assist the user when coupling the footwear structure to the blade as the user may grip the loop to facilitate insertion of the footwear structure within the blade.

Any coupling means, or combination of coupling means, is utilized in the present invention. For example, the straps, the recess, and the projection and locking housing may be utilized alone or in combination with all or one of the other means and/or other coupling means.

If desired, the footwear structure 12 may be placed on the top surface 83 before wrapping the flaps 18 and 20 about the dorsal portion of the user's foot 34.

What is claimed is:

1. A swimming flipper comprising:

a blade and a footwear structure removably coupled with said blade, said footwear structure including a sole having first and second lateral sides, a first flap attached to said first lateral side at a first side of said first flap, and a second flap attached to said second lateral side at a first side of said second flap, said flaps of a conformable material, wherein each flap is adapted to attach to and detach from the other flap and to conform about a dorsal portion of a user's foot when attached to the other flap and wherein when attached, said flaps are in covering relation with respect to said dorsal portion of said user's foot, wherein said flaps have a zig-zag perimeter including a cutout.

2. The swimming flipper of claim 1 wherein when attached, said cutout of said zig-zag perimeter of said first flap is covered by said second flap and wherein said cutout of said zig-zag perimeter of said second flap is filled in by said first flap.

3. The swimming flipper of claim 1 wherein said zig-zags are attached to one another.

* * * * *